US008865991B1

(12) United States Patent
Alves et al.

(10) Patent No.: US 8,865,991 B1
(45) Date of Patent: Oct. 21, 2014

(54) PORTABLE MUSIC PLAYER

(75) Inventors: Rogerio Guedes Alves, Macomb Township, MI (US); Kuan-Chieh Yen, Northville, MI (US); Bryan Neilson, Belle River (CA)

(73) Assignee: Cambridge Silicon Radio Limited (GB)

( * ) Notice: Subject to any disclaimer, the term of this patent is extended or adjusted under 35 U.S.C. 154(b) by 769 days.

(21) Appl. No.: 12/316,670

(22) Filed: Dec. 15, 2008

(51) Int. Cl.
*G10H 1/36* (2006.01)

(52) U.S. Cl.
USPC ..... 84/612; 84/609; 84/615; 84/636; 84/649; 84/652; 84/653; 84/668

(58) Field of Classification Search
None
See application file for complete search history.

(56) References Cited

U.S. PATENT DOCUMENTS

| | | | | |
|---|---|---|---|---|
| 7,521,623 | B2 * | 4/2009 | Bowen | 84/612 |
| 2003/0110926 | A1 * | 6/2003 | Sitrick et al. | 84/477 R |
| 2006/0230913 | A1 * | 10/2006 | Liao | 84/744 |
| 2006/0288842 | A1 * | 12/2006 | Sitrick et al. | 84/477 R |
| 2009/0139389 | A1 * | 6/2009 | Bowen | 84/636 |
| 2010/0186578 | A1 * | 7/2010 | Bowen | 84/612 |

OTHER PUBLICATIONS

Amir, A. et al., "Using Audio Time Scale Modification for Video Browsing," Proceedings of the 33rd Hawaii International Conference on System Science, p. 1-10 (IEEE, 2000).
Donnellan, O. et al., "Speech-Adpative Time-Scale Modification for Computer Assisted Language Learning," Proceedings of the 3rd IEEE Interna'l Conference of Advanced.
Macon, M. et. al, "Speech Concatenation and Synthesis Using an Overlap-Add Sinusoidal Model," Georgia Institute of Technology.
Wayman, J. et al., "Some Improvements on the Synchronized-Overlap-Add Method of Time Scale Modification for Use in Real-Time Speech Compression and Noise Filtering ," IEEE 1988.
Wong, J. et al., "Fast Time Scale Modification Using Envelope-Matching Technique (EM-TSM)," IEEE 1988, pp. V-550-V-552.

* cited by examiner

*Primary Examiner* — Marlon Fletcher
(74) *Attorney, Agent, or Firm* — John W. Branch; Lowe Graham Jones PLLC

(57) ABSTRACT

A portable music player for the playback of a digital audio file comprises a memory for storing a plurality of digital audio files; an audio output; a control for setting a desired change in pitch or tempo; and a digital signal processor configured to process a digital audio file and recover an audio signal therefrom, perceptibly alter one of the pitch and the tempo of the audio signal in response to the desired change in pitch or tempo without perceptibly altering the other of the pitch and tempo, and output the altered audio signal to the audio output.

14 Claims, 1 Drawing Sheet

PORTABLE MUSIC PLAYER

FIELD OF INVENTION

The present invention relates to a portable music player that can perceptibly alter the pitch or tempo of an audio signal without perceptibly altering the other of the pitch or tempo. In particular, the present invention relates to modifying the pitch or tempo in response to a variable input and uses for this input.

BACKGROUND

Audio signals, and especially audio signals containing music or speech, have two properties that share a tight inter-dependency. These two properties are the tempo, or duration of an audio signal, and the pitch. If the tempo of an audio signal is changed by altering the playback sampling rate of the audio signal, such that there is a change in the speed of playback of the audio signal, then there will be a corresponding change to the pitch of the audio signal.

Time-scale modification (TSM) of audio allows for the alteration of the tempo, or duration, of an audio signal without changing the pitch of any tonal components in the relevant part of the audio signal. This ability to alter the tempo and pitch allows the tight inter-dependency of these two properties to be relaxed. This results in the overall effect of speeding up or slowing down the perceived playback rate, or tempo, of a recorded audio signal without affecting the perceived pitch or timbre of the original audio signal.

TSM allows the duration, or tempo, of the original signal to be increased or decreased while the perceptually important features of the original signal remain significantly unchanged. For example, in the case of speech, the time-scaled audio signal can sound as if the original speaker has spoken at a quicker or slower rate, or in the case of music, the time-scaled signal can sound as if the musicians have played at a different tempo but with unaltered pitches throughout the audio signal.

TSM algorithms can also be used to achieve key shifting, or a change in the pitch of an audio signal, without altering the tempo, or perceived playback rate, of the voice or music. Key shifting, or the change of pitch, can be achieved by changing the playback sampling rate of the tempo changed TSM-processed audio signal so that there is no significant change in tempo but the pitch and formants would be shifted.

For example, an original 1.0 second long audio signal with pitch frequency of 800 Hz is sampled at 8 kHz. TSM can be used to speed up the audio signal by 20% so that the output audio signal is 0.8 second long and has a pitch frequency that stays at 800 Hz if the playback sampling rate remains 8 kHz. However, if the playback sampling rate is slowed down to 6.4 kHz, then the output audio signal would be back to 1.0 second long but the pitch frequency would be lowered to 640 Hz. The pitch would be perceptibly lower than in the original audio signal. In this example the slower playback sampling rate can be achieved by either physically changing the sampling rate of a digital-to-audio converter (DAC) to 6.4 kHz, or resampling (or stretching) the signal digitally by a 1:1.2 ratio while keeping the DAC at 8 kHz.

The key-shifting feature is popular in applications such as karaoke, where singers can move the pitch range of a song so that he or she can follow the song more easily.

Transforming audio to an alternative time-scale is a digital audio effect that has become a standard tool within many audio multi-progressing applications. For example, Donnellan et al ("Speech-adaptive time-scale modification for computer assisted language-learning", The 3rd IEEE International Conference on Advanced Learning Technologies, pp. 165-169, July 2003) describes applying a time-scale modification algorithm to natural-speed, native speech to aid students in learning a foreign language. This document discusses the merits of slowing down samples for use in computer-assisted language-learning. It describes using a TSM algorithm called synchronised overlap-add to extend the duration of sounds within the audio signal. This document also details varying the scaling of the speech within the audio signal such that the speech sounds natural after extension.

Amir et al ("Using audio time scale modification for video browsing", Proceedings of the 33rd Annual Hawaii International Conference on System Sciences, pp. 1117-1126, January 2000) details converting video/audio files to provide fast video browsing and uses a TSM algorithm to increase the speed of the speech present in the video/audio file. This increased speed audio content is then combined with a slide show of individual frames from the video content to enable the user to review the video/audio file in a shortened amount of time, whilst still understanding all of the audio present in the file.

Wong et al ("Fast time scale modification using envelope-matching technique (EM-TSM)", Proceedings of the IEEE International Symposium on Circuits and Systems, vol. 5, pp. 550-553, 1998) describes modifying the synchronized overlap-and-add TSM algorithm to include envelope matching with the intention of decreasing the computation complexity of the algorithm. The envelope matching TSM algorithm used in this document is tested on an audio clip including a male voice and a song with background music.

In Macon et al ("Speech Concatenation and Synthesis Using an Overlap-add Sinusoidal Model", IEEE International Conference on Acoustic, Speech and Signal Processing, vol. 1, pp. 361-364, May 1996) a TSM algorithm is used in a text-to-speech system. The speech audio signal is generated from the concatenation of short speech units taken from a pre-recorded library. A TSM algorithm is used to modify these short speech units to modify the duration and pitch so that they can be joined together smoothly to imitate natural speech.

It would be desirable to employ TSM algorithms in a more conventional mobile playback situation.

SUMMARY OF THE INVENTION

According to one aspect of the present invention there is provided a portable music player for the playback of a digital audio file, the music player comprising: a memory for storing a plurality of digital audio files; an audio output; a control for setting a desired change in pitch or tempo; and a digital signal processor configured to process a digital audio file and recover an audio signal therefrom, perceptibly alter one of the pitch or the tempo of the audio signal in response to the desired change in pitch or tempo without perceptibly altering the other of the pitch or tempo, and output the altered audio signal to the audio output.

According to a second aspect of the present invention there is provided a portable music player for the playback of a digital audio file, the music player comprising: a memory for storing a plurality of digital audio files; an audio output; an input connected to an exercise monitor configured to form an output representative of a measured exercise rate; and a digital signal processor configured to process a digital audio file and recover an audio signal therefrom, perceptibly alter one of the pitch or the tempo of the audio signal in response to the measured exercise rate without perceptibly altering the other of the pitch or tempo, and output the altered audio signal to the audio output.

According to a third aspect of the present invention there is provided a portable music player for the playback of a digital audio file, the music player comprising: a memory for storing a plurality of digital audio files; an audio output; a first control for setting a desired change in pitch a second control for setting a desired change in tempo; and a digital signal processor configured to process a digital audio file and recover an audio signal therefrom, perceptibly alter the pitch and the tempo of the audio signal in response to the desired change in pitch and tempo without the relative change in pitch and tempo being the same, and output the altered audio signal to the audio output.

The digital signal processor is preferably configured to use a time-scale modification algorithm to alter one of the pitch or the tempo of the digital audio file.

The portable music player preferably generates an ordered list of digital audio files and the digital signal processor is preferably further configured to detect the altered tempo of the digital audio file being output, and alter the audio signal recovered from the next digital audio file in the said list to match that of the detected altered tempo.

The portable music player preferably comprises a multifunction user interface, and the digital signal processor is preferably further configured to start accepting an input from the multifunction user interface as the said control when the audio signal starts to be output to the audio output and after a predetermined period of time revert to accepting the input from the multifunction user interface as another type of control. The multifunction user interface may include a remote volume control that functions as the said control for the predetermined amount of time.

The digital signal processor is preferably further configured to alter one of the pitch or the tempo in response to the difference between a desired exercise rate and the measured exercise rate. The digital signal processor is preferably further configured to use a time-scale modification algorithm to alter one of the pitch or the tempo of the digital audio file. The digital signal processor is preferably further configured to convert a numeric value of the measured exercise rate to a speech audio signal that is output at the same time as the altered audio signal.

The exercise monitor may be a heartbeat rate monitor and the output is representative of a measured heartbeat rate.

The exercise monitor may be a pedometer configured to form an output representative of a measured rate of steps per minute and the digital signal processor is further configured to alter the tempo of the digital audio file in response to the measured rate of steps per minute. The digital signal processor may be further configured to alter the tempo of the digital audio file in response to the difference between a desired steps per minute and the measured steps per minute.

The digital signal processor is preferably a dedicated sound processing integrated circuit. The digital signal processor preferably alters the tempo of the audio signal while not altering the pitch of the digital audio file by more than 0.3%.

BRIEF DESCRIPTION OF THE DRAWINGS

Embodiments of the invention will now be described, by way of example only, with reference to the accompanying drawings in which.

DETAILED DESCRIPTION

Embodiments of the present invention provides a portable music player for the playback of a digital audio file that can perceptibly alter one of the pitch or the tempo of an audio signal recovered from the audio file, without perceptibly altering the other of the pitch or the tempo of the audio signal. In one embodiment of the invention the portable music player controls one of the pitch or the tempo of the audio signal in response to a manual control than can be altered by the user of the portable music player. In another embodiment of the invention the portable music player alters one of the pitch or the tempo of the audio signal in response to an output representative of a measured exercise rate. In an alternate embodiment of the invention the portable music player can alter both the pitch and tempo of the audio signal in response to a set desired change in pitch and tempo without the relative change in pitch and tempo being the same.

Figure 1:
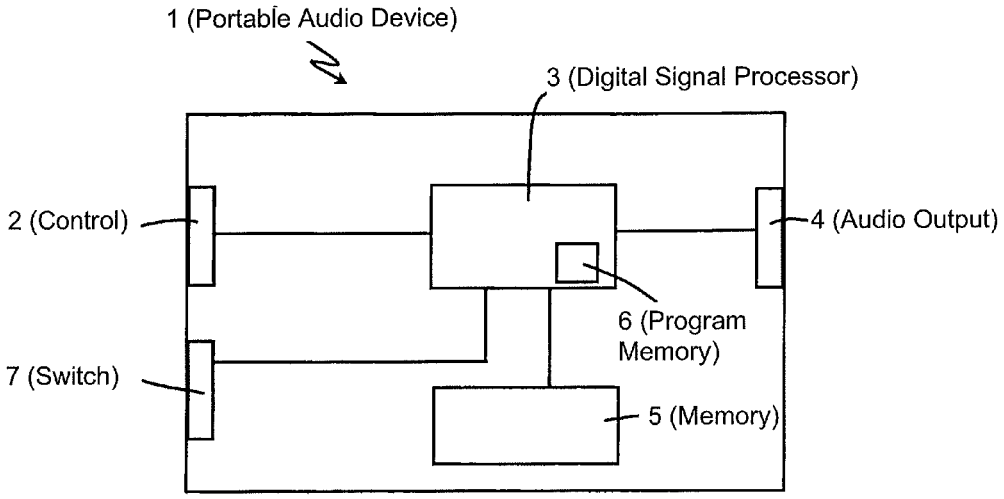
FIG. 1 shows a first preferred embodiment of the portable music player where the pitch or tempo of an audio signal is altered in response to an input from a control.

FIG. 1 shows a portable music player 1 for the playback of a digital audio file. The portable music player includes a memory 5 for storing a plurality of digital audio files. The memory 5 is connected to a digital signal processor 3 for the processing of a digital audio file to recover an audio signal from the digital audio file. After further processing of the audio signal the digital signal processor 3 outputs the processed audio signal to the audio output 4. The digital signal processor 3 can access a program memory 6 that stores computer programs for controlling the audio processing undertaken by the digital signal processor 3. Alternatively the program memory 6 may be part of the memory 5 for storing digital audio files. The portable music player 1 also includes a control 2, for example a thumb wheel, a touch sensitive panel or other user actuated controls, for setting a desired change in pitch or tempo. A switch 7 may also be included in the portable music player 1 that selects which of a desired change in pitch or tempo is being input using the control 2. Alternatively the portable music player 1 may have a first control and a second control that can be used to set one of the desired changes in pitch and tempo each.

The digital signal processor 3 receives a signal from the switch 7 indicating which of the pitch or tempo is to be altered. The digital signal processor 3 can then process the signal received from the control 2 as the selected one of the desired change in pitch or tempo. The signal received from the control 2 may be in the form of a variable voltage or a digital signal indicative of the desired value. The desired change in pitch or tempo is used by the digital signal processor 3 to the process the audio signal recovered from the digital audio file such that the one of the pitch or the tempo of the audio signal is perceptibly altered in response to the desired change in pitch or tempo. The digital signal processor 3 could process the audio signal using a known time-scale modification algorithm, such as that discussed in Macon et al, to make the required change. If both a desired change in pitch and tempo are selected using the control 2 then the digital signal processor 3 could then alter both the pitch and tempo of the audio signal being output.

The control 2 present on the portable music player 1 could be used to set the tempo of the audio signal such that each digital audio file has its tempo increased during playback. The tempo of the audio signal can be increased to provide a suitable number of beats per minute for exercising. Alternatively the control 2 could be set such that the audio signal generated from each digital audio file stored in the memory 5 is altered such that the tempo is decreased to a level suitable for relaxing to the music.

The portable music player 1 can also generate a list of digital audio files to be played. This list could also be ordered so that the digital audio files are played out in a specific order, for example in the order of play specified by the music album that they derived from. The user of the portable music player 1 may have manually specified the order and/or the list of digital audio files to be played. The audio signal representative of the first digital audio file in the list can then be processed by the digital signal processor 3 such that the tempo is altered in response to the desired change in tempo specified by the control 2. The digital signal processor 3 can then detect the tempo of the audio signal being output. This detected tempo can then be used to specify a change in tempo for the next digital audio file in the list such that the detected tempo of the audio signal being output matches that of the altered tempo of the audio signal recovered from the next digital audio signal in the list. This matching of the tempo between tracks allows the user to effectively set a desired tempo using the control, and then the digital music player matches this tempo between digital audio files.

The digital signal processor 3 can use the input provided by the control 2 to fast forward the audio signal derived from the digital audio file whilst still providing an audio output. The digital signal processor 3 can alter the tempo of the audio signal being output by a significant amount and therefore can effectively fast forward through the digital audio file and still provide the user with an audio output that does not have a perceptible change in the pitch.

The control 2 may be used by the portable music player 1 for multiple purposes, for example navigating a menu system, altering the volume level of the output audio signal and setting the desired change in tempo or pitch. In normal use the menu system would be used to select the mode in which the control 2 could be used by the digital signal processor 3 for setting the desired change in tempo or pitch. The digital signal processor 3 could be configured to automatically use the signal received from the control 2 for setting the desired change in tempo or pitch when an audio signal starts to be output. The digital signal processor 3 could then continue to accept the signal from the control 2 as the desired change in tempo or pitch for a set amount of time before reverting to using the signal from the control for the previous purpose.

In an alternate embodiment the portable music player 1 includes a multifunction user interface. This multifunction user interface may have multiple keys that the digital signal processor 3 can use for separate purposes. The digital signal processor 3 can then be set in a mode such that the digital signal processor 3 uses the signal received from one or more keys on the multifunction user interface analogously to the input from the control 2. The digital signal processor 3 could either use the input from the one or more keys analogously to the signal from the control 2 continuously or automatically enter a mode to use the signal from the one or more keys when an audio signal starts to be output. As described above the digital signal processor 2 could return to using the signal from the one more keys for the previous purpose after a set amount of time. This allows the user to conveniently set the desired change in tempo or pitch at the start of each digital audio file before being able to use the keys on the multifunction user interface for another purpose after the beginning portion of the digital audio file. The multifunction user interface could be an external remote control that includes a volume control. When the digital signal processor 3 is in the above described mode the digital signal processor 3 could use the volume control as the control for setting the desired change in pitch or tempo.

The control 2 can also set a desired change in pitch and this could enable the portable music player to change the key of the music present in the audio signal. This would enable the portable music player 1 to allow the user to sing or play along to the music present in the audio signal in a key that is better suited to the user's voice or instrument. The portable music player 1 can also have an audio input that could be connected to microphone. This audio input could be connected to the digital signal processor 3. The digital signal processor 3 can then be set in a mode using the menu system of the portable music player 1 so that it accepts an audio signal from the audio input. The digital signal processor 3 then mixes this audio signal from the audio input with the processed audio signal and outputs this mixed audio signal to the audio output 4. The mixed audio signal could also be recorded or stored to the memory 5 if desired.

Figure 2:
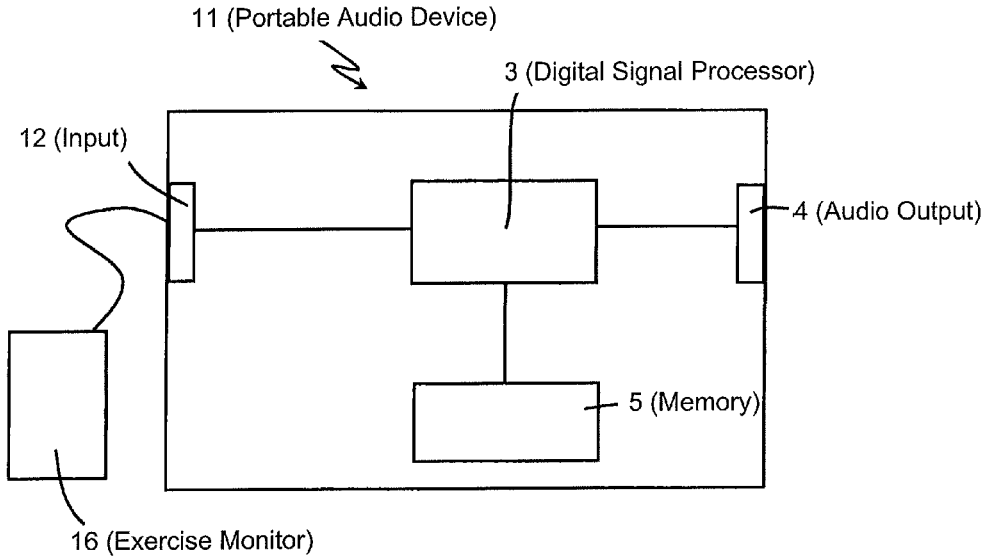
FIG. 2 shows a second preferred embodiment of the portable music player where the pitch or tempo of an audio signal is altered automatically in response to an input from an exercise monitor.

FIG. 2 shows a second embodiment of the portable music player 11 for the playback of digital audio files. In this embodiment the portable music player 11 includes an input 12 that is connected to an exercise monitor 16. The exercise monitor 16 could be a sensor capable of giving an indication of the pace generated by the user. Furthermore, the exercise monitor 16 could collect data about the user's body, for example heartbeat rate per minute, pulse, breathing rate, or body temperature, and/or data connected with the activity undertaken, for example steps or strides per minute, the cadence on a bicycle or the number of rowing strokes per minute. The exercise monitor 16 could also comprise a GPS to allow for the measurement of the speed of the user. The exercise monitor 16 could collect data from just one source or use multiple sources to provide an indication of the exercise rate. The exercise monitor 16 could have sensors attached to the user's body.

The exercise monitor 16 provides an output that is representative of a measured exercise rate. The exercise monitor 16 could be an external device that is physically or wirelessly connected to the input 12 on the portable music player 11. Alternatively the exercise monitor 16 could be part of the portable music player 11.

The digital signal processor 3 is connected to a memory 5 for storing a plurality of digital audio files. The digital signal processor 3 can recover an audio signal from a digital audio file and then in response to the measured exercise rate provided by the exercise monitor 16 alter perceptibly one of the pitch or the tempo of the audio signal whilst not perceptibly altering the other. This altered audio signal can then be output to the audio output 4.

In this embodiment the portable music player 11 could be used by the user to achieve a desired exercise rate. The portable music player 11 could alter the tempo of the audio signal being output to provide the user with an auditory signal as to whether the current exercise rate matches the desired rate. When the exercise rate is too low the portable music player 11 could increase the tempo of the audio signal to stimulate the user and encourage the user to work harder. Alternatively the tempo of the audio signal could be decreased to, signal to the user that the exercise rate is too low. Conversely, when the exercise rate is deemed to be too high the digital signal processor 3 could decrease the tempo of the audio signal to relax the user and make the user exercise at a slower rate. Alternatively the tempo of the audio signal could be increased to indicate to the user that the exercise rate is too high. By enabling the portable music player 11 to alter the tempo of the audio signal in response to the exercise rate the portable music player 11 can provide information to the user on the current exercise rate without the user being distracted from their exercise. When the user is undertaking exercise it may be inconvenient for the user to look at a display showing an indication of the exercise rate.

The digital signal processor 3 could also convert a numeric value of the measured exercise rate to a speech audio signal to be output at the same time as the altered audio signal. This would provide the user with an absolute value of the exercise rate from the speech audio signal, whilst still providing an indication of the exercise rate from the altered audio signal. If the digital signal processor increased/decreased the tempo when the exercise rate was too low/too high respectively then the audio signal could help the user to exercise faster whilst enabling the user to know the value of the exercise rate via the speech audio signal.

The exercise monitor 16 could be a heart rate monitor and the user could set a desired heart beat rate for the exercise period. The audio signal could then be altered to allow the user to achieve the desired heart beat rate.

Alternatively, the exercise monitor 16 could be a pedometer. In this case the digital signal processor may alter the tempo of the audio signal to make the user achieve a desired rate of steps per minute.

When the digital signal processor 3 is processing the audio signal being output certain sections of the audio signal may take less time to process than the actual playback time of that section. In this situation the digital signal processor 3 could store the portion of the altered audio signal that is awaiting output in a memory, such as memory 6, and continue to process the next section of the audio signal. The output audio signal can then be drawn from the memory while the digital signal processor processes the next section of the audio signal. When a section of the audio file is encountered by the digital signal processor 3 that requires more time to process than the actual playback time of that section, the next stored portion of the audio signal can be output while the digital signal processor processes this section of the audio signal. In this situation the audio signal would be read out of the memory without a next portion being written. If the audio signal portion in the cache is longer than the difference between the processing time of the section of the audio signal and the actual playback time of that section then continuous playback will occur. This allows the portable music player 1, 11 to account for sections of the audio signal that take a longer time to process than the actual playback time.

The "portable music player" detailed above generally refers to a computing device that is dedicated to the processing of music and videos containing music. The portable nature of the player indicates that the user can listen to music or watch videos wherever the user travels. The portable nature of the music player means that it will include a self-contained power supply such as a battery. The portable music player can then function using this self-contained power supply without being connected to an external power source such as a wired power source.

The applicant hereby discloses in isolation each individual feature described herein and any combination of two or more such features, to the extent that such features or combinations are capable of being carried out based on the present specification as a whole in the light of the common general knowledge of a person skilled in the art, irrespective of whether such features or combinations of features solve any problems disclosed herein, and without limitation to the scope of the claims. The applicant indicates that aspects of the present invention may consist of any such individual feature or combinations of features. In view of the foregoing description it will be evident to a person skilled in the art that various modifications may be made within the scope of the invention.

What is claimed is:

1. A portable music player for the playback of a digital audio file, the music player comprising:

a memory for storing a plurality of digital audio files;

an audio output;

a control for setting a desired change in one of pitch and tempo;

a multifunction user interface; and a digital signal processor configured to (i) process a digital audio file and recover an audio signal therefrom, (ii) perceptibly alter one of the pitch and the tempo of the audio signal in response to the desired change in the respective one of pitch and tempo without perceptibly altering the other of the pitch and tempo, (iii) output the altered audio signal to the audio output, and (iv) automatically (a) start accepting an input from the multifunction user interface as the control for setting the desired change in one of pitch and tempo when the audio signal starts to be output to the audio output, and (b) after a predetermined period of time, revert to accepting the input from the multifunction user interface as another type of control for a previous purpose.

2. A portable music player as claimed in claim 1, wherein the digital signal processor is further configured to use a time-scale modification algorithm to alter one of the pitch and the tempo of the digital audio file.

3. A portable music player as claimed in claim 1, wherein the portable music player generates an ordered list of digital audio files and the digital signal processor is further configured to detect the altered tempo of the digital audio file being output, and alter the audio signal recovered from the next digital audio file in the list to match that of the detected altered tempo.

4. A portable music player as claimed in claim 1, wherein the multifunction user interface includes a remote volume control that functions as the control for the predetermined amount of time.

5. A portable music player for the playback of a digital audio file, the music player comprising:

a memory for storing a plurality of digital audio files;

an audio output;

an input connected to an exercise monitor configured to form an output representative of a measured exercise rate;

a multifunction user interface; and a digital signal processor configured to (i) process a digital audio file and recover an audio signal therefrom, (ii) perceptibly alter one of the pitch and the tempo of the audio signal in response to the measured exercise rate without perceptibly altering the other of the pitch and tempo, (iii) output the altered audio signal to the audio output, (iv) convert a numeric value of the measured exercise rate to a speech audio signal that is output at the same time as the altered audio signal, and (v) automatically (a) start accepting a user input from the multifunction user interface as a control for setting a desired change in one of pitch and tempo when the audio signal starts to be output to the audio output, and (b) after a predetermined period of time, revert to accepting the user input from the multifunction user interface as another type of control for a previous purpose.

6. A portable music player as claimed in claim 5, wherein the digital signal processor is further configured to alter one of the pitch and the tempo in response to the difference between a desired exercise rate and the measured exercise rate.

7. A portable music player as claimed in claim 5, wherein the digital signal processor is further configured to use a time-scale modification algorithm to alter one of the pitch and the tempo of the digital audio file.

8. A portable music player as claimed in claim 5, wherein the exercise monitor is a heartbeat rate monitor and the output is representative of a measured heartbeat rate.

9. A portable music player as claimed in claim 5, wherein the exercise monitor is a pedometer configured to form an output representative of a measured rate of steps per minute and the digital signal processor is further configured to alter the tempo of the digital audio file in response to the measured rate of steps per minute.

10. A portable music player as claimed in claim 9, wherein the digital signal processor is further configured to alter the tempo of the digital audio file in response to the difference between a desired steps per minute and the measured steps per minute.

11. A portable music player for the playback of a digital audio file, the music player comprising:

a memory for storing a plurality of digital audio files;

an audio output;

a first control for setting a desired change in pitch a second control for setting a desired change in tempo;

a multifunction user interface; and a digital signal processor configured to (i) process a digital audio file and recover an audio signal therefrom, (ii) perceptibly alter the pitch and the tempo of the audio signal in response to the desired change in pitch and tempo without the relative change in pitch and tempo being the same, (iii) output the altered audio signal to the audio output, and (iv) automatically (a) start accepting an input from the multifunction user interface as one of the first and second control when the audio signal starts to be output to the audio output, and (b) after a predetermined period of time, revert to accepting the input from the multifunction user interface as another type of control for a previous purpose.

12. A portable music player as claimed in claim 11, wherein the digital signal processor is a dedicated sound processing integrated circuit.

13. A portable music player as claimed in claim 12, wherein the digital signal processor alters the tempo of the audio signal while not altering the pitch of the digital audio signal by more than 0.3%.

14. A portable music player as claimed in claim 11, wherein the digital signal processor alters the tempo of the audio signal while not altering the pitch of the digital audio signal by more than 0.3%.

* * * * *